United States Patent [19]

Harris

[11] 4,019,501

[45] Apr. 26, 1977

[54] CPR BREASTPLATE COMPRESSION AID

[76] Inventor: Jack R. Harris, 2606 W. Wolf St., Phoenix, Ariz. 85017

[22] Filed: Feb. 20, 1976

[21] Appl. No.: 659,673

[52] U.S. Cl. ..... 128/24 R; 128/28

[51] Int. Cl.[2] ..... A61H 1/00

[58] Field of Search ..... 128/24, 53, 54, 28; 35/17

[56] References Cited

UNITED STATES PATENTS

| | | | |
|---|---|---|---|
| 3,199,225 | 8/1965 | Robertson et al. | 35/17 |
| 3,219,031 | 11/1965 | Rentsch, Jr. | 128/51 |
| 3,276,147 | 10/1966 | Padellford | 35/17 |
| 3,307,541 | 3/1967 | Hewson | 128/145.8 |
| 3,489,140 | 1/1970 | Mullikin | 128/51 |

FOREIGN PATENTS OR APPLICATIONS

| | | | |
|---|---|---|---|
| 664,727 | 11/1964 | Italy | 35/17 |

*Primary Examiner*—John D. Yasko
*Attorney, Agent, or Firm*—Warren F. B. Lindsley

[57] ABSTRACT

A hollow rubber chamber filled with a fluid and equipped with a pressure gauge, the chamber being designed for placement over the sternum of a heart victim while giving external cardiac compression as a means for restoring heart action. As force is applied to the sternum through the hollow rubber chamber, the gauge registers the amount of pressure applied and thus aids in the optimum administration of the Cardio Pulmonary Resuscitation (CPR) procedure.

8 Claims, 6 Drawing Figures

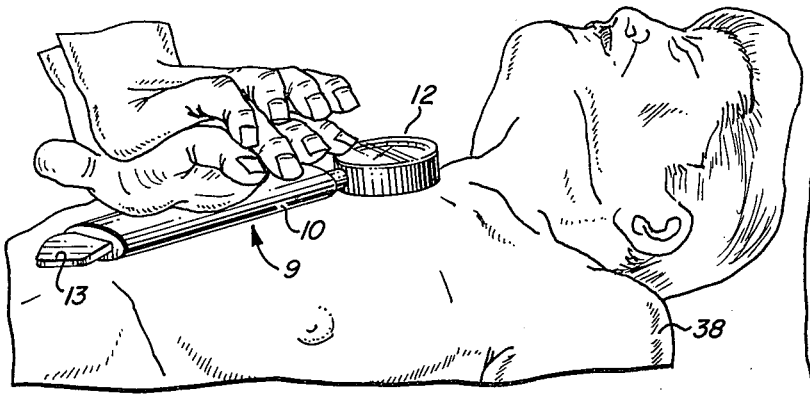
FIG. 1
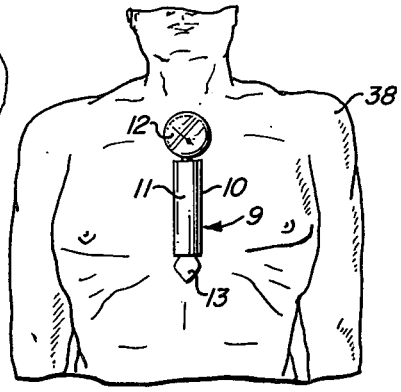
FIG. 2
FIG. 3
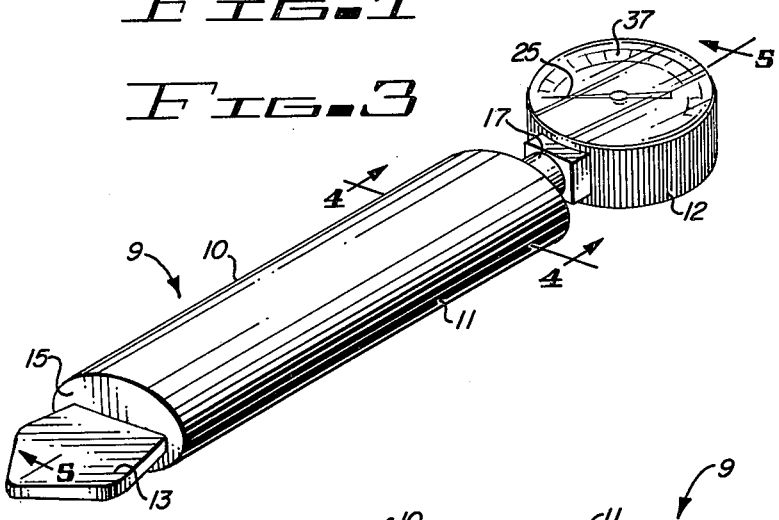
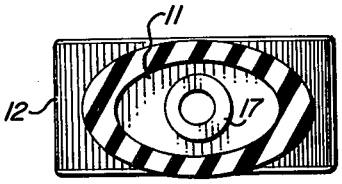
FIG. 4
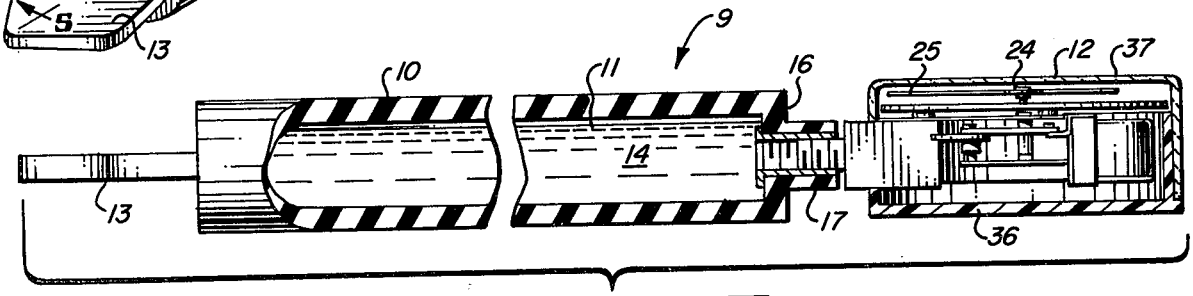
FIG. 5
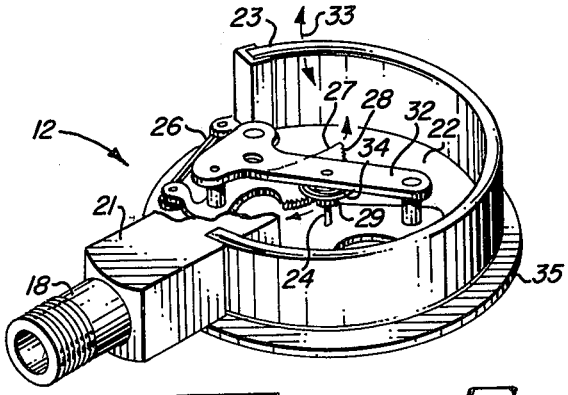
FIG. 6

CPR BREASTPLATE COMPRESSION AID

BACKGROUND OF THE INVENTION

During the past few years many lives have been saved through the effective use of Cardio Pulmonary Resuscitation (CPR) techniques. In incidents of heart failure or fibrillation and interruption of natural breathing as brought about by electric shock or other causes, these natural functions are often restored by means of artificial circulation (external cardiac compression) and mouth-to-mouth resuscitation.

In the administration of the CPR technique, the victim's heart is compressed by means of a gradually applied pressure exerted against the sternum, sufficient pressure being applied to drive the sternum one and one-half to two inches toward the spine, and thereby to cause blood to be exhausted from the ventricles. The pressure is then released to allow the return of blood to the auricles. The compression stroke is applied by the palm of one hand assisted by the other hand placed on top of the first, and it is applied repeatedly at a steady rate approximating the normal heartbeat. Because such heart failure is almost invariably accompanied by interruption of the breathing function, mouth-to-mouth resuscitation is given at the same time. If only one rescue person is involved, two breathing cycles are applied for every fifteen heart strokes. It two persons are available to perform rescue operations, one applies external cardiac compression while the other gives mouth-to-mouth resuscitation.

Because of increased publicity and education regarding these techniques and their efficacy in restoring such victims, CPR has been credited with the saving of increasing numbers of lives in recent years.

At the same time, it is evident that a still higher degree of success can be achieved through improved educational methods and equipment and through the provision of any other means which might assure the optimum application of the CPR technique with less dependence upon the skill or practice of the rescue personnel. It is difficult for someone of limited experience, for example, to know when he is applying sufficient pressure. It is also especially difficult to judge whether such proper pressure is being sustained as fatigue begins to be felt by the person administering the technique.

It is clear, therefore, that an effective mechanical aid for gauging the pressure applied to the sternum, in turn compressing the heart, is urgently needed and that such a device might realistically be expected to save many lives.

SUMMARY OF THE INVENTION

In accordance with the invention claimed, a CPR breastplate compression aid is provided which gives to the practitioner of the CPR technique a visual indication of the pressure applied to the victim's sternum.

It is therefore one object of this invention to provide a device which indicates the amount of pressure applied to the breastplate of a heart attack victim during external cardiac compression.

Another object of this invention is to provide such a device which has utility both as a training aid and as a means for assuring proper application of the CPR technique.

A further object of this invention is to provide such a device in a form which will aid in the determination of the proper point of application of the compressive force.

A still further object of this invention is to provide a visual pressure indication as an aid in the determination of the proper amount of pressure appropriate for the particular victim to which aid is being administered.

A still further object of this invention is to reduce the hazard of bodily harm such as fractured ribs which can result from excessive pressure.

Yet another object of this invention is to provide such a visual pressure indication as an aid in assuring that the appropriate pressure is sustained even as fatigue begins to interfere with the judgement of the person administering the CPR technique.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which:

FIG. 1 is a perspective view of the CPR breastplate compression aid of the invention being employed in the administration of external cardiac compression to a heart attack victim;

FIG. 2 is another view of the device properly positioned over the sternum of the victim;

FIG. 3 is an enlarged perspective view of the breastplate compression aid;

FIG. 4 is a sectional view of the compression aid as seen along line 4—4 of FIG. 3;

FIG. 5 is a sectional view of the compression aid as seen along line 5—5 of FIG. 3; and FIG. 6 is an enlarged perspective view of the internal assembly of the gauge portion of the compression aid of FIGS. 1–5.

DESCRIPTION OF THE PREFERRED EMBODIMENT

Referring more particularly to the drawing by characters of reference, FIGS. 1–5 disclose a CPR breastplate compression aid 9 comprising an elongated member 10 defining a hollow chamber 11 arranged along its length and having a pressure gauge 12 attached at one end in fluid pressure contact with the chamber. A flat pointed tab 13 is arranged to extend from the other end of the member. Chamber 11 is filled with a fluid 14.

In the preferred embodiment, the general outline of chamber 11 together with tab 13 approximates the shape and dimensions of the sternum of an adult person with tab 13 resembling the xiphoid at the base of the sternum. The chamber 11 and tab 13 are made of rubber or of a similarly flexible synthetic meterial.

Chamber 11 is shown as having an oval cross-sectional configuration in FIGS. 4 uniform along its total length. The lower end is closed by a perpendicular wall 15 to the center of which tab 13 is perpendicularly attached. The upper end is closed by a perpendicular wall 16 which has a cylindrical neck 17 extending perpendicularly therefrom along the axis of member 10. Neck 17 is designed to be slipped over the hose connection fitting 18 of the gauge 12. The entire chamber 11 including the neck 17, the ends 15 and 16 and the attached tab 13 are molded and fused into an integral structure. The walls of the chamber 11 are relatively thick and capable of supporting pressures in excess of 40 psi and 150 pounds of thrust without undue distortion such as bulging or pronounced stretching.

While any suitable fluid pressure gauge may be devised or adapted for the purpose, the gauge 12 in the preferred embodiment is a Bourdon gauge, the internal structure of which is shown in FIG. 6 to include the circular Bourdon tube 19 with one end coupled into a hollow brass chamber 21 which carries the fitting 18. The fitting 18 is secured to the frame plate 22 of gauge 12. The free end 23 of tube 19 is coupled to the pivot pin 24 of the pointer or needle 25 by mechanical linkages including a lever arm 26 and a rocker arm 27. Arm 27 has a notched arcuate edge 28 which engages a toothed gear 29 which is carried by pin 24. The rocker arm 27 is pivotally supported by a pin 31 which is carried between the main frame plate 22 and a second parallel frame member 32 spaced above plate 22.

The tube 19 is a hollow brass tube having an elliptical cross-section. It is bent in the form of an incomplete circle of approximately 270°. The fluid 14 which fills chamber 11 also fills tube 19 having access thereto via fitting 18 and chamber 21. When pressure is applied to chamber 11, the fluid pressure inside tube 19 increases causing the elliptical cross-section of tube 19 to tend toward a circular cross-section. This distortion of the cross-section of tube 19 causes the free end of tube 19 to move outward as indicated by arrow 33. The outward motion is translated into a rotational displacement of pin 24 and needle 25 through the action of arms 26 and 27. The needle 25 is steadied by a restraining spiral spring 34.

The structure of gauge 12 is completed by a calibrated face plate 35, a sealed plastic housing 36 and a transparent face 37.

The fluid 14 may be any non-corrosive liquid such as mineral oil, glycerine or water. Air is undesirable because of its excessive compression.

In applying the aid 9, the chamber 11 is lined up with the sternum of the victim 38 as shown in FIGS. 1 and 2 with the tab 13 lying directly over the xiphoid and the meter 12 lying flat on the victim's chest just above the upper end of the sternum. The person administering external cardiac compression places the palm of one hand on top of the chamber 11 aligning the rearward edge of the hand directly over the center of chamber 11. The palm of the second hand is placed on top of the first hand so that both arms (kept straight) may be utilized along with the upper body to apply the considerable pressure required. The first compression stroke is then applied while observation is made of both the meter 12 and of the amount of downward displacement of the sternum. Depending upon the size of the victim, the correct amount of displacement is about 1½ to 2 inches. The pressure reading shown at this amount of displacement is the appropriate pressure to be applied in subsequent compression strokes. Typically, the estimated correct pressure for an adult women is 60–70 pounds and for an adult man, it is 85–100 pounds. For a child of ten years or older, 40 pounds is appropriate. The calibrated scale of the gauge 12 is marked in downward pounds of thrust so that the pressure may be read directly.

If one person is performing the rescue operation without assistance, he applies fifteen strokes in series, applying compression smoothly rather than abruptly to force the blood from the ventricles into the lungs and other parts of the body, then releasing the pressure to allow the blood to return to the auricles. After each fifteen strokes, he breathes twice into the victim's lungs to replenish his oxygen supply. As he continues this procedure, he watches the gauge 12 to insure that the proper amount of pressure is applied at each stroke, the aid 9 facilitating the proper control of the pressure regardless of the fatigue felt by the rescue person.

In applying pressure through the body of chamber 11, care should be taken to insure that the chamber 11 is not rolled from side to side. Such rolling indicates that pressure is not being applied directly downward in the appropriate manner.

When properly applied in the foregoing manner, the aid 9 will remain correctly positioned over the sternum and will thus continue to serve as a marker of the proper point on the victim's chest for the application of the compression stroke.

If two persons are available to administer CPR, one person can perform artificial circulation while the other simultaneously administers mouth-to-mouth resuscitation. The person administering resuscitation should also feel for the carotid pulse in the neck during the downward compression stroke. The presence of the pulse indicates adequate pressure, and the appropriate pressure is that which just produces the pulse. By this means, the optimum gauge reading may be more accurately determined.

An effective aid is thus provided for use in external cardiac compression which offers a number of important advantages. It serves as a soft padding or rubber between the hand and the sternum. It raises the hand completely off the chest so that only the sternum is compressed, not the ribs. It insures the proper vertical direction of the compression stroke and it serves as a fixed marker of the proper location for the application of the stroke. The gauge will read correctly regardless of whether the victim is lying on a hard or soft surface. By insuring that the applied pressure is only sufficient to pump the blood, excessive pressure which might inflict unnecessary bodily harm is effectively prevented.

It will be recognized that the aid 9 may be readily employed in training exercises with a dummy or manikin simulating the victim. In this way, the paramedic or anyone else desiring to learn the proper CPR techniques may develop a feel for the proper amount of pressure as he practices the procedure. The skill thus developed through the use of the aid 9 will be of benefit in an actual emergency whether or not the aid is then available for use.

Although but a single embodiment of the invention has been illustrated and described, it will be apparent to those skilled in the art that various changes and modifications may be made therein without departing from the spirit of the invention or from the scope of the appended claims.

What is claimed is:

1. A breastplate compression aid for placement on the chest of a human victim over the victim's sternum comprising:

an elongated compressible hollow member having approximately the length and shape of the sternum of an adult person, said member defining a closed hollow chamber along its length having substantially an oval cross-sectional configuration, a pressure gauge attached at one end of said member in fluid pressure contact with the hollow interior of said member, the other end of said member being provided with means for indicating the position of the base of the victim's sternum, fluid means for filling said chamber, whereby when said aid is placed on the body of a victim over the sternum with the longer dimension of said chamber co-planar with the surface of the victim's body and pressure is applied to said member, it will be transferred to the victim's sternum and a representation thereof indicated on said gauge.

2. The breastplate compression aid set forth in claim 1 wherein:

said means for indicating the position of the base of said victim's sternum comprises a tab extending axially out of said member along its longitudinal axis.

3. The breastplate compression aid set forth in claim 2 wherein:

said tab resembles the xiphoid at the base of a human sternum.

4. The breastplate compression aid set forth in claim 1 wherein:

said member and tab are formed of a flexible synthetic material.

5. The breastplate compression aid set forth in claim 1 wherein:

said member and tab are formed of flexible rubber.

6. The breastplate compression aid set forth in claim 1 wherein:

said pressure gauge comprises a Bourdon gauge.

7. The breastplate compression aid set forth in claim 1 wherein:

said fluid means comprises a non-corrosive liquid.

8. The breastplate compression aid set forth in claim 2 wherein:

said gauge and tab are axially aligned with the longitudinal axis of said member and indicia on each are co-planar arranged.

* * * * *